US006250995B1

(12) United States Patent
Hakomori

(10) Patent No.: US 6,250,995 B1
(45) Date of Patent: Jun. 26, 2001

(54) APPARATUS FOR POLISHING OUTER PERIPHERY OF WORKPIECE

(75) Inventor: Shunji Hakomori, Tokyo (JP)

(73) Assignee: Speedfam Co., Ltd., Tokyo (JP)

( * ) Notice: Subject to any disclaimer, the term of this patent is extended or adjusted under 35 U.S.C. 154(b) by 0 days.

(21) Appl. No.: 09/403,585

(22) PCT Filed: Feb. 23, 1999

(86) PCT No.: PCT/JP99/00793

§ 371 Date: Dec. 16, 1999

§ 102(e) Date: Dec. 16, 1999

(87) PCT Pub. No.: WO99/43467

PCT Pub. Date: Sep. 2, 1999

(30) Foreign Application Priority Data

Feb. 27, 1998 (JP) ..... 10-64593

(51) Int. Cl.[7] ..... B24B 9/06

(52) U.S. Cl. ..... 451/66; 451/44; 451/57; 451/194

(58) Field of Search ..... 459/57, 43, 44, 459/65, 58, 177, 66, 178, 194, 195, 209, 210, 63

(56) References Cited

U.S. PATENT DOCUMENTS 5,040,342 * 8/1991 McGuire et al. ..... 451/44
5,094,037 * 3/1992 Hakomori et al. ..... 451/43
5,097,630 * 3/1992 Maeda et al. ..... 451/194
5,514,025 * 5/1996 Hasegawa et al. ..... 451/44
5,658,189 * 8/1997 Kagamida et al. ..... 451/66
5,674,110 * 10/1997 Cuoghi ..... 451/44
6,159,081 * 12/2000 Hakomori ..... 451/57

* cited by examiner

*Primary Examiner*—Joseph J. Hail, III
*Assistant Examiner*—George Nguyen
(74) *Attorney, Agent, or Firm*—Michael K. Kelly; Snell & Wilmer, LLP

(57) ABSTRACT

To provide a small polishing means featuring high machining efficiency that is capable of efficiently and quickly mirror-polishing an outer periphery of a chamfered workpiece (5) by bringing the outer periphery into even contact with a plurality of polishing drums (2, 2) at the same time. In an apparatus for polishing an outer periphery by bringing an outer periphery of the workpiece (5) retained by workpiece retaining means (3*a*, 3*b*) into contact with two polishing drums (2, 2) simultaneously to perform mirror polishing, the workpiece retaining means (3*a*, 3*b*) are supported by a sliding mechanism (16) such that they may move in a direction in which the two polishing drums (2, 2) are arranged, thereby to form an aligning means. In addition, the workpiece retaining means (3*a*, 3*b*) are provided with loading means (30) for absorbing a force applied to the workpiece retaining means in an X direction, the force being generated due to contact between the rotating workpiece (5) and the polishing drums (2, 2).

20 Claims, 2 Drawing Sheets

APPARATUS FOR POLISHING OUTER PERIPHERY OF WORKPIECE

TECHNICAL FIELD

The present invention relates to an apparatus for mirror-polishing a chamfered outer peripheral portion of a substantially disk-shaped workpiece such as a semiconductor wafer or a magnetic disk substrate.

BACKGROUND ART

For example, semiconductor wafers such as silicon wafers are usually subjected to chamfering of their peripheries mainly to prevent their edges from chipping or to prevent crowns during epitaxial growth. The chamfering is performed by grinding with a diamond grinding wheel; however, distorted layers are apt to remain after grinding. The remaining distorted layers lead to crystal defects in some cases when heat treatment is repeated in a device process.

For that reason, the distorted layers are normally removed by etching. Etched surfaces, however, tend to develop undulated or scale-like irregularities which tend to retain soil. The soil spreads over an entire wafer in the device process, contributing greatly to deterioration of characteristics.

In recent years, a technique for smoothing chamfered edges of wafers by mirror polishing has been established as a technique completely different from that for polishing the surfaces of wafers. The applicants of the present invention have already proposed a technique for polishing edges as disclosed, for example, in Japanese Unexamined Patent Publication No. 1-71656. According to the polishing technique, a wafer having a chamfered edge on its outer periphery is rotated, and the outer periphery edge is pressed against a working plane of the outer periphery of a rotating polishing drum thereby to polish the outer periphery edge. This method enables wafer edges to be polished easily and reliably, and solves all the problems caused by the chamfering mentioned above.

However, this type of polishing apparatus is designed to perform polishing by bringing wafers into point contact with polishing drums; hence, machining efficiency is not always high, taking a considerable time for the machining. In these days, therefore, contrivance has been added. An example of such contrivance is increasing the diameter of a polishing drum to maximize the length of contact with a wafer so as to shorten the machining time.

However, a method in which a round wafer is brought into circumferential contact with a cylindrical working plane is disadvantageous in that there is limitation in extending the contact length, so that reducing the machining time is accordingly limited. In addition, increasing the diameter of the polishing drum means a larger space required for installation, inevitably resulting in an increased size of the apparatus including the drum. Especially because demands for larger wafers having diameters ranging from 30 cm to 40 cm are expected in the future, which means larger spaces occupied by the wafers, the polishing apparatuses would undesirably be even larger.

DISCLOSURE OF INVENTION

An object of the present invention is to provide a small polishing means featuring high machining efficiency that is capable of performing mirror polishing efficiently and quickly by simultaneously bringing chamfered outer peripheries of workpieces into uniform contact with a plurality of polishing drums.

To this end, according to one aspect of the present invention, there is provided an apparatus for polishing an outer periphery of a workpiece, comprising: a workpiece retaining means for rotatably retaining a disk-shaped workpiece having a chamfered edge on its outer periphery; a set of rotatable polishing drums which simultaneously polishes the outer periphery of the workpiece retained by the workpiece retaining means, a set being formed of two polishing drums; an aligning means that supports the workpiece retaining means and two polishing drums so that they can be relatively shifted in a direction in which the two polishing drums are arranged, and performs positional adjustment to bring a workpiece into uniform contact with the two polishing drums; and loading means for absorbing an action force in an eccentric direction produced between the workpiece retaining means and the polishing drums due to contact between a rotating workpiece and the polishing drums.

The polishing apparatus in accordance with the present invention is adapted to simultaneously polish an outer periphery of a workpiece by a plurality of polishing drums, thus permitting improved polishing efficiency and a shorter polishing time. Moreover, polishing drums of considerably smaller diameters than those of conventional polishing drums are employed, so that a smaller polishing apparatus can be achieved.

Furthermore, freedom in the direction in which the two polishing drums are arranged is provided between the workpiece retaining means and the polishing drums so as to automatically correct uneven contact by aligning action even if a workpiece comes in uneven contact with the two polishing drums, and the action force in an eccentric direction generated due to contact between a rotating workpiece and the polishing drums is absorbed by the loading means. This arrangement makes it possible to positively bring a workpiece into contact with the two polishing drums under even contact pressure.

According to a specific composition mode of the present invention, the aligning means is formed of a sliding mechanism that supports the workpiece retaining means such that it may move in the direction in which the two polishing drums are arranged, and the loading means is coupled to the workpiece retaining means so that the workpiece retaining means is urged in a direction opposite from a direction of the action force.

The loading means may be formed of a weight.

According to another specific composition mode of the present invention, the workpiece retaining means is supported by the sliding mechanism in a direction to move toward or away from the polishing drums, and also coupled to the loading means for applying contact pressure to press a workpiece against the polishing drums under a fixed contact pressure.

According to a specific composition mode of the present invention, the workpiece retaining means can be tilted and an axis of a retained workpiece is tilted in a plane, which is at right angles to a plane that includes axes of two polishing drums, thereby to simultaneously bring a chamfered edge of the workpiece into contact with the two polishing drums.

According to another specific composition mode of the present invention, the workpiece retaining means can be tilted, and an axis of a retained workpiece is tilted in a plane, which is slanted with respect to a plane that includes axes of two polishing drums, thereby to bring a chamfered edge of the workpiece into contact with one of the polishing drums, and to bring a non-chamfered peripheral side surface into contact with the other polishing drum.

According to still another specific composition mode, a polishing apparatus has two, namely, a first and a second, sets of workpiece retaining means, these workpiece retaining means being disposed at positions where they oppose each other with two polishing drums located therebetween, and a workpiece transporting means that reverses the front/rear side of a workpiece of the first workpiece retaining means and transports the workpiece to the second workpiece retaining means.

BEST MODE FOR CARRYING OUT THE INVENTION

Figure 1:
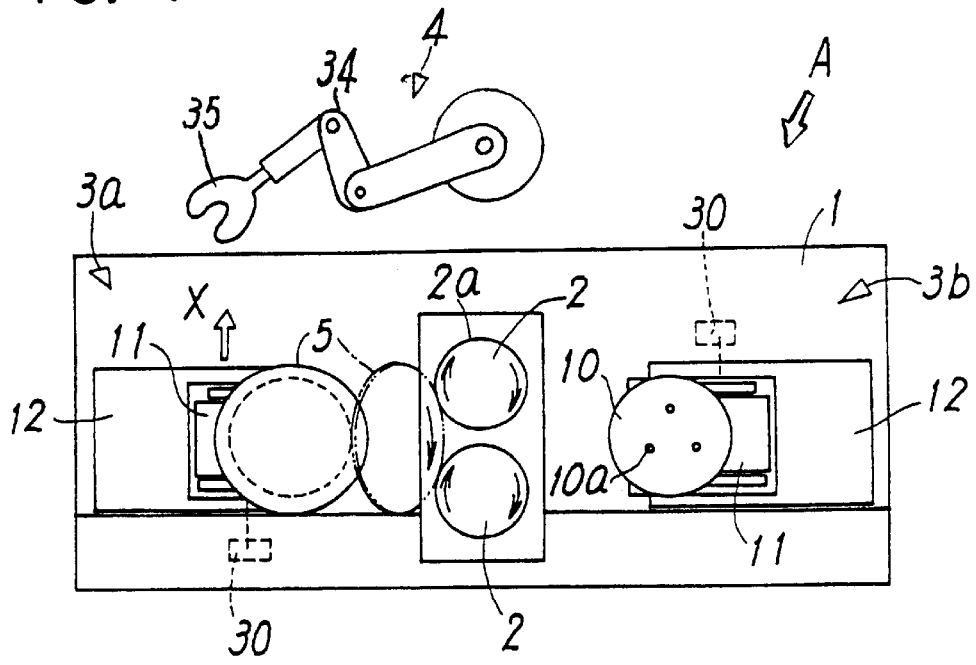
FIG. 1 is a top plan view showing a first embodiment of an outer periphery polishing apparatus in accordance with the present invention.
Figure 2:
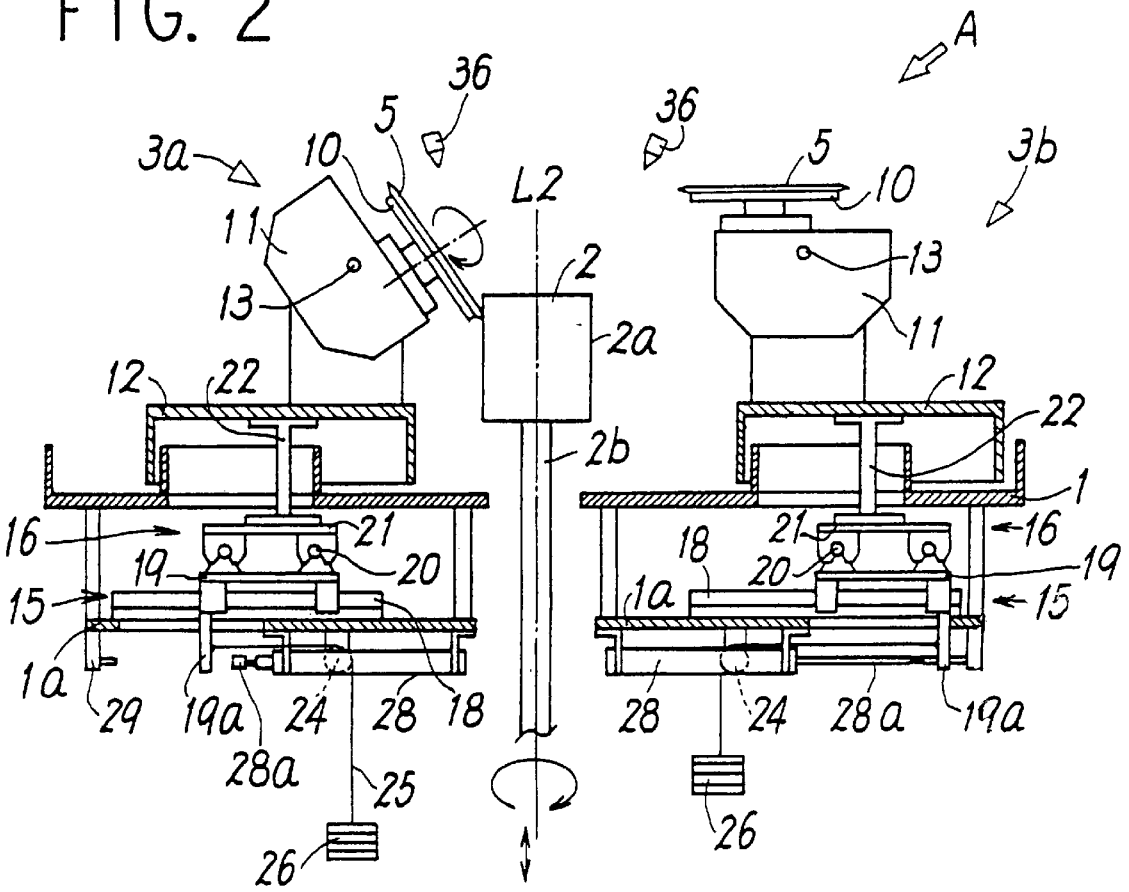
FIG. 2 is a longitudinal sectional front view of the outer periphery polishing apparatus of FIG. 1.
Figure 3:
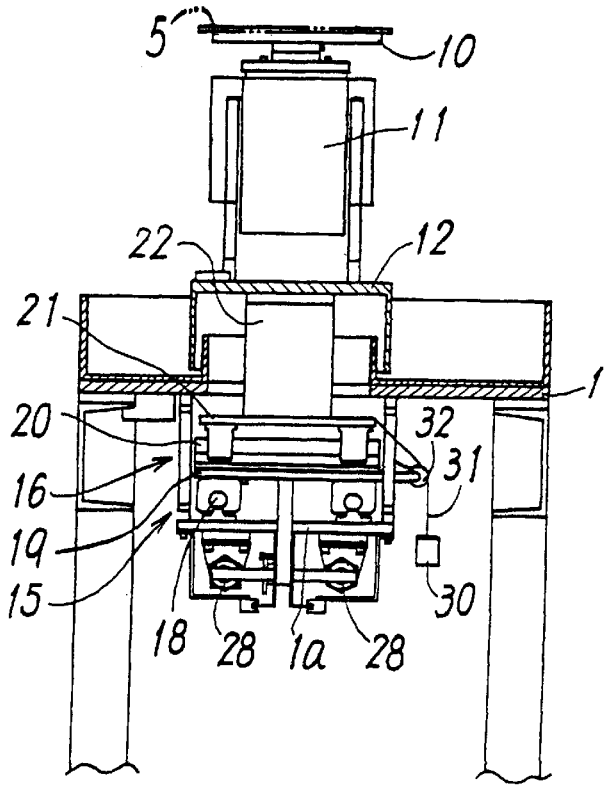
FIG. 3 is a longitudinal sectional side view of the outer periphery polishing apparatus of FIG. 1.

FIG. 1 through FIG. 3 show a first embodiment of an outer periphery polishing apparatus in accordance with the present invention. A polishing apparatus A has a machine body 1, two cylindrical polishing drums 2 and 2 provided side by side on the machine body 1, two, namely, a first and a second, workpiece retaining means 3*a* and 3*b* that are disposed to oppose a first side and a second side with the polishing drums 2 and 2 located therebetween, and a workpiece transporting means 4 for carrying in/out workpieces and for reversing front/rear sides of workpieces.

Outer peripheral surfaces of the polishing drums 2 and 2 are formed into working planes 2*a* for polishing by attaching polishing pads to the outer surfaces of base cylinders. The two polishing drums 2 and 2 sharing the same composition are provided in parallel with a gap maintained therebetween, the gap being smaller than a diameter of a workpiece 5. Each of the polishing drums 2 and 2 is rotatable about its own axis L2. Drum shafts 2*b* of the polishing drums 2 and 2 are coupled to driving sources such as motors, and run, for example, at approximately 500 to 1000 r.p.m. in the same direction or in opposite directions from each other at the same speed or at different speeds.

Each of the drum shafts 2*b* is supported by the machine body 1 so that it may reciprocate in the direction of its own axis L2, and coupled to a moving means which is composed primarily of a ball screw and a nut member threadedly engages the ball screw and which is not shown. This arrangement enables the respective polishing drums 2 and 2 to move in synchronization in an axial direction at a slow speed during machining. The polishing drums 2 and 2 may move in the same direction, or opposite directions from each other so that, when one moves forward, the other moves backward.

Figure 4:
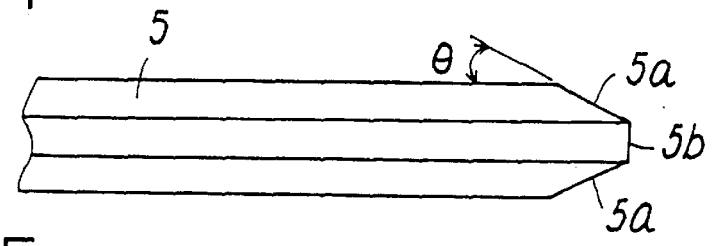
FIG. 4 is a side view of an essential section of a workpiece.

The first and second workpiece retaining means 3*a* and 3*b* hold the disk-shaped workpiece 5, an outer periphery of which having edges 5*a* and 5*a* chamfered at an angle (and a non-chamfered peripheral side surface 5*b* (see FIG. 4), and rotate it about an axis. The first and second workpiece retaining means 3*a* and 3*b*, which share the same configuration, also function to simultaneously bring the edges 5*a* of the workpiece 5 into contact with the working surfaces 2*a* and 2*a* of the two polishing drums 2 and 2.

More specifically, each of the workpiece retaining means 3*a* and 3*b* has a chucking head 10 for vacuum-chucking the workpiece 5, a first body 11 that rotatably supports the chucking head 10, and a second body 12 that supports the first body 11 such that it may tilt on a support shaft 13.

The chucking head 10 has a plurality of suction holes 10*a* in its surface. These suction holes 10*a* are connected to a vacuum source via ports, piping tubes, etc. provided in the first body 11 and the second body 12, although not shown.

A motor for driving the chucking head 10 is installed inside the first body 11. The chucking head 10 is driven by the motor at a low speed, e.g. about one revolution in 40 to 60 seconds.

Furthermore, the first body 11 circularly moves on the support shaft 13 and involves a non-polishing position where the chucking head 10 is oriented horizontally to retain the workpiece 5 in a position away from the polishing drums 2 and 2 as indicated by the workpiece retaining means 3*b* in FIG. 2, and a polishing position where the chucking head 10 tilts to bring the outer periphery of the workpiece 5 into contact with the two polishing drums 2 and 2 as indicated by the workpiece retaining means 3*a* in the same drawing. In this case, the support shafts 13 are provided such that they are horizontal and parallel to a plane that includes the axes of the two polishing drums 2 and 2. Hence, when the first body 11 tilts forward on the support shaft 13, the axis of the workpiece 5 tilts in a plane, which is at right angles to a plane that includes the axes of the two polishing drums 2 and 2. This causes the edge 5*a*, which is one of the chamfered edges 5*a* of the workpiece 5, to be simultaneously brought into contact with the two polishing drums 2 and 2.

The second body 12 is supported by two, namely, a first and a second, sliding mechanisms 15 and 16 such that it may move in two directions orthogonalized with each other.

The first sliding mechanism 15 functions to move the workpiece retaining means 3*a* and 3*b* in a first direction in which the workpiece 5 is moved into contact with or away from the polishing drums 2 and 2. The first sliding mechanism 15 has a first rail 18 that is installed on a substrate 1*a* made integral with the machine body 1 and extends in the first direction, and a first sliding member 19 that is able to move along the first rail 18.

The second sliding mechanism 16 constitutes an aligning means for performing positional adjustment so as to bring the workpiece 5 into even contact with the two polishing drums 2 and 2. The second sliding mechanism 16 has a second rail 20 that is installed on the first sliding member 19 and extends in the second direction in which the two polishing drums 2 and 2 are arranged, and a second sliding member 21 that is able to move along the second rail 20. The second body 12 is mounted on the second sliding member 21 by a leg 22.

A pulley 24 is installed on the bottom surface of the substrate 1*a*a wire 25 being wound around the pulley 24. One end of the wire 25 is fixed to an arm 19*a* extending downward from the first sliding member 19, and a weight 26 serving as a first loading means is suspended from the other end of the wire 25. The first sliding member 19, that is, the workpiece retaining means 3*a* or 3*b*, is always pulled on the first rail 18 toward the polishing drums 2 and 2 by the weight 26.

An air cylinder 28 is also attached to the bottom surface of the substrate 1*a* the distal end of a rod 28*a* of the air cylinder 28 being abutted against the arm 19*a*. When the rod 28*a* extends to push the arm 19*a*, the first sliding member 19, that is, the workpiece retaining means 3*a* or 3*b*, is moved back on the first rail 18 in the direction for moving away from the polishing drums 2 and 2. The rod 28*a* and the arm 19*a* are merely abutted against each other and are not coupled. Therefore, a force for advancing the workpiece retaining means 3*a* or 3*b* toward the polishing drums 2 and 2 when the rod 28*a* is contracted is obtained by the weight 26. In other words, the weights 26 serve as driving means for moving the workpiece retaining means 3*a* and 3*b* toward the polishing drums 2 and 2 and also as loading means for pressing the workpiece against the polishing drums 2 and 2 under a fixed contact pressure while the outer periphery of the workpiece 5 is being polished.

Reference numeral 29 in the drawings denotes a stopper for restricting a retreat position of the arm 19*a*.

One side surface of the second sliding member 21 is provided with a second loading means 30 that urges the workpiece retaining means 3*a* or 3*b* toward one end of the second direction. The second loading means 30 is formed of a weight that is suspended from the distal end of a wire 31 with a proximal end thereof fixed to the second sliding member 21. The middle of the wire 31 is supported by a pulley 32 attached to the first sliding member 19.

As shown in FIG. 1, when a rotating workpiece 5 is brought into contact with the polishing drums 2 and 2 that are rotating in the opposite direction from the workpiece 5, a frictional force therebetween causes a force in a tangential direction to be applied to the workpiece 5. This action force causes the workpiece retaining means 3*a* or 3*b* to shift in an X direction on the second rail 20, frequently resulting in uneven contact of the workpiece 5 with respect to the polishing drums 2 and 2. To correct this, the action force is absorbed by the second loading means 30 so as to bring the workpiece 5 into even contact with the polishing drums 2 and 2. Accordingly, the direction of a load applied by the second loading means 30 to the workpiece retaining means 3*a* or 3*b* is opposite from the X direction in which the action force is applied.

In general, an appropriate value of the magnitude of the force that can be applied by the second loading means 30 is smaller than an urging force, namely, about a fraction thereof, which is applied by the first loading means 26, although it depends upon the magnitude of the action force applied to the workpiece 5.

If the rotational directions of the polishing drums 2 and 2 and the workpiece 5 remain always constant, then the direction of the action force remains always the same; therefore, the second loading means 30 may be provided only on either right or left side surface of each of the workpiece retaining means 3*a* and 3*b*. In a case where the rotational directions of the polishing drums 2 and 2 and the workpiece 5 are reversed as in the case of polishing a workpiece that has an orientation flat in a part of the outer periphery thereof, it is desirable to provide the second loading means 30 on both right and left side surfaces of each of the workpiece retaining means 3*a* and 3*b* so that they can be selectively used as required.

The work transporting means 4 has a chucking head 35 for vacuum-chucking a workpiece at the distal end of an extendable chucking arm 34. The work transporting means 4 performs an operation for supplying an unmachined workpiece from a loading section to the chucking head 10 of the first workpiece retaining means 3*a* by the chucking head 35, an operation for reversing the front/rear side of the workpiece 5 with the edge 5*a* on the front side polished and transferring the workpiece 5 from the first workpiece retaining means 3*a* to the second workpiece retaining means 3*b*, and an operation for carrying out a workpiece with the edge 5*a* on the rear side polished from the second workpiece retaining means 3*b* to an unloading section.

Reference numeral 36 in FIG. 2 denotes a nozzle for supplying an abrasive slurry to a portion to be polished.

In the polishing apparatus having the configuration described above, when an unmachined workpiece is supplied by the work transporting means 4 to the chucking head 10 of the first workpiece retaining means 3*a* located in the non-polishing position, the first body 11 tilts forward on the support shaft 13 by an angle decided by the chamfered angle (of the edge 5*a* as shown in FIG. 2. As the rod 28*a* of the air cylinder 28 contracts, the first sliding member 19 advances on the first rail 18 toward the polishing drums 2 and 2, and the edge 5*a* of the front side of the rotating workpiece 5 held by the chucking head 10 is brought into contact with the working surfaces 2*a* and 2*a* of the outer peripheries on the first side of the rotating two polishing drums 2 and 2 so as to polish the edge 5*a* of the front side.

The contact pressure of the workpiece applied to the working surfaces 2*a* is obtained by the weight 26, which is the first loading means. More specifically, as the rod 28*a* of the air cylinder 28 contracts, the workpiece retaining means 3*a* advances on the first rail 18, and the moment the workpiece 5 reaches the polishing drums 2 and 2, the workpiece retaining means 3*a* stops at that position, whereas the rod 28*a* continues to contract to move away from the arm 19*a* of the first sliding member 19. Hence, the full gravitational force of the weight 26 acts upon the workpiece retaining means 3*a*, causing the workpiece to be pressed against the two polishing drums 2 and 2 by the gravitational force of the weight 26.

At this time, even if the workpiece 5 comes in uneven contact with the two polishing drums 2 and 2, the workpiece retaining means 3*a* shifts in the second direction to automatically perform alignment thereby to cause the workpiece 5 to be in even contact with the two polishing drums 2 and 2. This is because the second sliding mechanism 16 provides the workpiece retaining means 3*a* with the freedom in the direction in which the two polishing drums 2 and 2 are arranged.

Furthermore, the force applied to the workpiece retaining means 3*a* in the X direction generated by the contact between the rotating workpiece 5 and the polishing drums 2 and 2 is cancelled by an urging force of the second loading means 30 that urges the workpiece retaining means 3*a* in the opposite direction therefrom. This arrangement prevents uneven contact of the workpiece 5 due to shifting of the workpiece retaining means 3*a*, permitting the workpiece to be positively in contact with the two polishing drums 2 and 2 always with an even force.

Thus, the edge 5*a* on the front surface side of the workpiece 5 is brought into contact with the working surfaces 2*a* and 2*a*, simultaneously, of the two polishing drums 2 and 2 to undergo mirror polishing at two different points. During the polishing process, the two polishing drums 2 and 2 slowly reciprocate in the directions of their own axes L2 to change the positions of contact with the workpiece.

Upon completion of polishing the edge 5*a* of the front surface side of the workpiece, the first workpiece retaining means 3*a* is moved back by the air cylinder 28, the workpiece 5 moves away from the polishing drums 2 and 2, and the first body 11 is reset to the non-polishing position where the workpiece is horizontally oriented.

Subsequently, the work transporting means 4 receives the workpiece 5 from the first workpiece retaining means 3*a* and reverses the front or rear side of the workpiece 5 before supplying it to the second workpiece retaining means 3*b*. The second workpiece retaining means 3*b* polishes the edge 5*a* on the rear surface side on the second side of the two polishing drums 2 and 2 in the same manner as in the case where the edge on the front surface side is polished.

Preferably, the working surfaces 2*a* and 2*a* of the polishing drums 2 and 2 are sufficiently flexible to allow the peripheral side surface 5*b* to dig into them by at least about half the width thereof when polishing the edge 5*a*. This arrangement makes it possible to polish the outer peripheral side surface 5*b* while polishing the edges 5*a* and 5*a* on the front and rear surfaces at the same time.

Upon completion of polishing the edge 5*a* on the rear surface side, the second workpiece retaining means 3*b* moves to the non-polishing position where the workpiece transporting means 4 receives the workpiece from the second workpiece retaining means 3*b* and carries it to the unloading section.

In the embodiment set forth above, the first and second loading means 26 and 30 are formed of weights; however, one or both of weights may be replaced by an air cylinder or air cylinders with a spring or springs or pressure regulating means.

Furthermore, the two polishing drums 2 and 2 are installed to be parallel to each other; however, they may be slanted such that the distal ends thereof approach each other.

In addition, the illustrated embodiment is provided with two sets of workpiece retaining means to separately polish the edges of the front and rear surfaces of a workpiece by these workpiece retaining means. The embodiment, however, may alternatively be adapted to polish the edges of the front surface and the rear surface, respectively, of a workpiece in sequence by each of the respective workpiece retaining means. In this case, only one set of workpiece retaining means may be provided.

Figure 5:
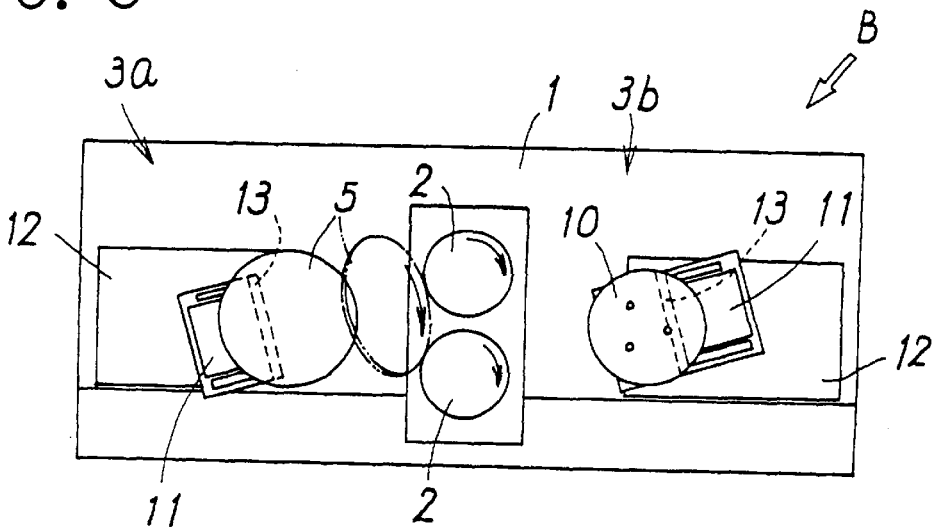
FIG. 5 is a top plan view showing a second embodiment of the outer periphery polishing apparatus in accordance with the present invention.

FIG. 5 illustrates a second embodiment of the outer periphery polishing apparatus in accordance with the present invention. A polishing apparatus B of the second embodiment differs from the polishing apparatus A of the first embodiment in the following aspect. The polishing apparatus A of the first embodiment is configured to polish the chamfered edge 5*a* of the workpiece 5 and about half the non-chamfered peripheral side surface 5*b* by simultaneously bringing them into contact with the two polishing drums 2 and 2, while the polishing apparatus B of the second embodiment is configured to bring the edge 5*a* of the workpiece 5 into contact with one polishing drum 2 and to bring the peripheral side surface 5*b* into contact with the other polishing drum 2 to polish them.

More specifically, in the polishing apparatus B of the second embodiment, the support shafts 13 tiltably supporting the first bodies 11 of the workpiece retaining means 3*a* and 3*b* are disposed such that they are oriented aslant with respect to a plane that includes the axes of the two polishing drums 2 and 2. When the first body 11 tilts forward on the support shaft 13, the axis of the retained workpiece 5 tilts within a plane that is slanted with respect to a surface S that includes the axes of the two polishing drums 2 and 2. Thus, the edge 5*a* of the workpiece 5 is polished by being brought into contact primarily with one polishing drum 2, while the peripheral side surface 5*b* is polished by being brought into contact primarily with the other polishing drum 2.

In this case, the support shafts 13 of the two workpiece retaining means 3*a* and 3*b* are tilted in the same direction; therefore, the polishing drums with which the edge 5*a* of the retained workpiece 5 comes in contact and the polishing drums with which the peripheral side surface 5*b* comes in contact are different between the two workpiece retaining means 3*a* and 3*b*.

Preferably, the tilting angles of the support shafts 13 are set such that the axis of the tilted workpiece 5 and the axis of the polishing drum with which the edge 5*a* comes in contact lie in the same plane to permit one polishing drum to be positively brought into contact with a full width of the edge 5*a* at a central part of the workpiece 5, although appropriate values of the tilting angles vary depending on the size, etc. of the workpiece 5.

The composition of the polishing apparatus B of the second embodiment is substantially identical to that of the first embodiment except for the part set forth above; therefore, like major components are designated by like reference numerals as those of the first embodiment, and the description thereof will be omitted.

In the embodiments described above, the aligning means are provided on the workpiece retaining means 3*a* and 3*b* to urge the workpiece retaining means 3*a* and 3*b* by the loading means 30; however, they may alternatively be provided on the polishing drums 2 and 2. More specifically, the two polishing drums 2 and 2 may be integrally formed and supported by the aligning means such that they may be shifted in the direction in which they are arranged, and the loading means 30 may be provided on the polishing drums 2 and 2.

Thus, according to the present invention, since the outer periphery of a workpiece is brought into contact with a plurality of polishing drums at the same time to mirror-polish it at the plural points simultaneously, higher polishing efficiency and considerably reduced polishing time can be achieved. Moreover, polishing drums having significantly smaller diameters than conventional polishing drums can be used, so that an extremely smaller space occupied by these polishing drums and a workpiece can be accomplished, permitting a smaller apparatus to be realized.

The freedom in the direction in which the two polishing drums are arranged is provided between the workpiece retaining means and the polishing drums. This arrangement makes it possible to automatically correct uneven contact by aligning operation even if a workpiece comes in uneven contact with the two polishing drums and to absorb an action force in the eccentric direction, which is generated due to the contact between a rotating workpiece and the polishing drums, by the loading means. Thus, a workpiece can be positively brought into contact with the two polishing drums under an even contact pressure.

Reference Numerals

| | |
|---|---|
| 1 | Machine body |
| 1a | Substrate |
| 2 | Polishing drum |
| 2a | Working surface |
| 3a | First workpiece retaining means |
| 3b | Second workpiece retaining means |

-continued

| Reference Numerals | |
|---|---|
| 4 | Work transporting means |
| 5 | Workpiece |
| 5a | Edge |
| 5b | Peripheral side surface |
| 10 | Chucking head |
| 11 | First body |
| 12 | Second body |
| 13 | Support shaft |
| 15 | First sliding mechanism |
| 16 | Second sliding mechanism |
| 18 | First rail |
| 19 | First sliding member |
| 19a | Arm |
| 20 | Second rail |
| 21 | Second sliding member |
| 22 | Leg |
| 24 | Pulley |
| 25 | Wire |
| 26 | Weight |
| 28 | Air cylinder |
| 29 | Stopper |
| 30 | Second loading means |
| 31 | Wire |
| 32 | Pulley |
| 34 | Chucking arm |
| 35 | Chucking head |
| 36 | Nozzle |

What is claimed is:

1. An apparatus for polishing an outer periphery of a workpiece, comprising:

at least one workpiece retaining means for rotatably retaining a disk-shaped workpiece having a chamfered edge on an outer periphery thereof;

a set of rotatable polishing drums which simultaneously polishes the outer periphery of the workpiece retained by said workpiece retaining means, said set being formed of two polishing drums;

an aligning means that supports said workpiece retaining means and two polishing drums such that they can be relatively shifted in a direction in which said two polishing drums are arranged, and performs positional adjustment to bring a workpiece into even contact with the two polishing drums; and alignment loading means for absorbing an action force in an eccentric direction produced between said workpiece retaining means and said polishing drums due to contact between a rotating workpiece and rotating polishing drums.

2. An apparatus for polishing an outer periphery according to claim 1, wherein said aligning means comprises a rail extending in the direction in which the two polishing drums are arranged, and a sliding member that is able to move on said rail; said workpiece retaining means is mounted on said sliding member; and said loading means is coupled to the workpiece retaining means such that a load in a direction opposite from the direction of said action force is applied.

3. An apparatus for polishing an outer periphery according to claim 2, wherein said loading means is a weight.

4. An apparatus for polishing an outer periphery according to claim 1, wherein said workpiece retaining means is movably supported by a sliding mechanism such that it moves in a direction for moving into contact with or away from the polishing drums, and is coupled to a contact pressure loading means for pressing a workpiece against the polishing drums under a fixed contact pressure.

5. An apparatus for polishing an outer periphery according to claim 4, wherein said sliding mechanism is formed of a rail and a sliding member that moves on said rail, and said contact pressure loading means is formed of a weight.

6. An apparatus for polishing an outer periphery according to claim 1, wherein said workpiece retaining means is tiltable, and an axis of a retained workpiece is tilted in a plane, which is at right angles to a plane that includes axes of the two polishing drums, thereby to bring a chamfered edge of the workpiece into the two polishing drums at the same time.

7. An apparatus for polishing an outer periphery according to claim 4, wherein said workpiece retaining means is tiltable, and an axis of a retained workpiece is tilted in a plane, which is at right angles to a plane that includes axes of the two polishing drums, thereby to bring a chamfered edge of the workpiece into the two polishing drums at the same time.

8. An apparatus for polishing an outer periphery according to claim 1, wherein said workpiece retaining means is tiltable, and an axis of a retained workpiece is tilted in a plane inclined with respect to a plane that includes axes of the two polishing drums thereby to bring a chamfered edge of the workpiece into contact with one of the two polishing drums and to bring a non-chamfered peripheral side surface into contact with the other polishing drum.

9. An apparatus for polishing an outer periphery according to claim 4, wherein said workpiece retaining means is tiltable, and an axis of a retained workpiece is tilted in a plane inclined with respect to a plane that includes axes of the two polishing drums thereby to bring a chamfered edge of the workpiece into contact with one of the two polishing drums and to bring a non-chamfered peripheral side surface into contact with the other polishing drum.

10. An apparatus for polishing an outer periphery according to claim 1, said polishing apparatus comprising two, namely, a first and a second, sets of workpiece retaining means, these workpiece retaining means being disposed at positions where they oppose each other with the two polishing drums located therebetween, and a workpiece transporting means that reverses a front/rear side of a workpiece that has been polished by said first workpiece retaining means and transports the workpiece to the second workpiece retaining means.

11. An apparatus for polishing an outer periphery according to claim 4, said polishing apparatus comprising two, namely, a first and a second, sets of workpiece retaining means, these workpiece retaining means being disposed at positions where they oppose each other with the two polishing drums located therebetween, and a workpiece transporting means that reverses a front/rear side of a workpiece that has been polished by said first workpiece retaining means and transports the workpiece to the second workpiece retaining means.

12. An apparatus for polishing an outer periphery according to claim 6, said polishing apparatus comprising two, namely, a first and a second, sets of workpiece retaining means, these workpiece retaining means being disposed at positions where they oppose each other with the two polishing drums located therebetween, and a workpiece transporting means that reverses a front/rear side of a workpiece that has been polished by said first workpiece retaining means and transports the workpiece to the second workpiece retaining means.

13. An apparatus for polishing an outer periphery according to claim 8, said polishing apparatus comprising two, namely, a first and a second, sets of workpiece retaining means, these workpiece retaining means being disposed at positions where they oppose each other with the two polishing drums located therebetween, and a workpiece transporting means that reverses a front/rear side of a workpiece that has been polished by said first workpiece retaining means and transports the workpiece to the second workpiece retaining means.

14. An apparatus for polishing an outer periphery according to claim 2, wherein said workpiece retaining means is movably supported by a sliding mechanism such that it moves in a direction for moving into contact with or away from the polishing drums, and is coupled to a contact pressure loading means for pressing a workpiece against the polishing drums under a fixed contact pressure.

15. An apparatus for polishing an outer periphery according to claim 3, wherein said workpiece retaining means is movably supported by a sliding mechanism such that it moves in a direction for moving into contact with or away from the polishing drums, and is coupled to a contact pressure loading means for pressing a workpiece against the polishing drums under a fixed contact pressure.

16. An apparatus for polishing an outer periphery according to claim 2, wherein said workpiece retaining means is tiltable, and an axis of a retained workpiece is tilted in a plane, which is at right angles to a plane that includes axes of the two polishing drums, thereby to bring a chamfered edge of the workpiece into the two polishing drums at the same time.

17. An apparatus for polishing an outer periphery according to claim 2, wherein said workpiece retaining means is tiltable, and an axis of a retained workpiece is tilted in a plane inclined with respect to a plane that includes axes of the two polishing drums thereby to bring a chamfered edge of the workpiece into contact with one of the two polishing drums and to bring a non-chamfered peripheral side surface into contact with the other polishing drum.

18. An apparatus for polishing an outer periphery according to claim 2, said polishing apparatus comprising two, namely, a first and a second, sets of workpiece retaining means, these workpiece retaining means being disposed at positions where they oppose each other with the two polishing drums located therebetween, and a workpiece transporting means that reverses a front/rear side of a workpiece that has been polished by said first workpiece retaining, means and transports the workpiece to the second workpiece retaining means.

19. An apparatus for polishing an outer periphery according to claim 7, said polishing apparatus comprising two, namely, a first and a second, sets of workpiece retaining means, these workpiece retaining means being disposed at positions where they oppose each other with the two polishing drums located therebetween, and a workpiece transporting means that reverses a front/rear side of a workpiece that has been polished by said first workpiece retaining means and transports the workpiece to the second workpiece retaining means.

20. An apparatus for polishing an outer periphery according to claim 9, said polishing apparatus comprising two, namely, a first and a second, sets of workpiece retaining means, these workpiece retaining means being disposed at positions where they oppose each other with the two polishing drums located therebetween, and a workpiece transporting means that reverses a front/rear side of a workpiece that has been polished by said first workpiece retaining means and transports the workpiece to the second workpiece retaining means.

* * * * *